US007788864B2

(12) United States Patent
Jacobsen

(10) Patent No.: US 7,788,864 B2
(45) Date of Patent: Sep. 7, 2010

(54) WINDOW WITH SCREENING ARRANGEMENT

(75) Inventor: Per Jacobsen, Horsens (DK)

(73) Assignee: VKR Holdings A/S, Soeborg (DK)

( * ) Notice: Subject to any disclaimer, the term of this patent is extended or adjusted under 35 U.S.C. 154(b) by 687 days.

(21) Appl. No.: 10/563,422

(22) PCT Filed: Jul. 1, 2004

(86) PCT No.: PCT/DK2004/000469

§ 371 (c)(1),
(2), (4) Date: Jan. 5, 2006

(87) PCT Pub. No.: WO2005/005762

PCT Pub. Date: Jan. 20, 2005

(65) Prior Publication Data

US 2008/0120930 A1 May 29, 2008

(30) Foreign Application Priority Data

Jul. 9, 2003 (DK) ..... 2003 01047

(51) Int. Cl.
*E06B 7/14* (2006.01)

(52) U.S. Cl. ..... 52/209; 52/204.5; 52/204.55

(58) Field of Classification Search ..... 52/209, 52/204.5, 656.7, 204.55; 160/40, 93, 94
See application file for complete search history.

(56) References Cited

U.S. PATENT DOCUMENTS 1,022,870 A * 4/1912 Power ..... 454/218
1,211,053 A * 1/1917 Bernard ..... 160/92
1,857,911 A * 5/1932 Johnson ..... 454/216

(Continued)

FOREIGN PATENT DOCUMENTS

AU 527915 4/1981

(Continued)

OTHER PUBLICATIONS

English-language translation of JP61-76034 (2 pages).

(Continued)

*Primary Examiner*—Basil Katcheves
(74) *Attorney, Agent, or Firm*—Merek, Blackmon & Voorhees, LLC

(57) ABSTRACT

The window (1) comprises a frame (2) having a top member (3), a bottom member (4) and two side members (6), and a sash (7) having a top member (8), a bottom member (9) and two side members (10, 11). A screening arrangement (12) is provided in order to cover the ventilating aperture at least partly in the ventilating position. To achieve a discreet screening arrangement having minimum influence on the functioning of the window, the screening arrangement (12) includes at least one screening element (13, 23, 33), which, in a closed position of the window (1), is arranged in a storage position at the interface between frame (2) and sash (7), and in the ventilating position extends between the frame bottom member (4) and the sash bottom member (9), and/or between the frame top member (3) and the sash top member (8). Each of the screening elements (13, 23, 33) is connected with the sash or frame top or bottom member (8, 3, 9, 4) and is in releasable engagement with the corresponding frame (3, 4) or sash member (8, 9) within the limited angle range.

19 Claims, 9 Drawing Sheets

U.S. PATENT DOCUMENTS

Figure 1:
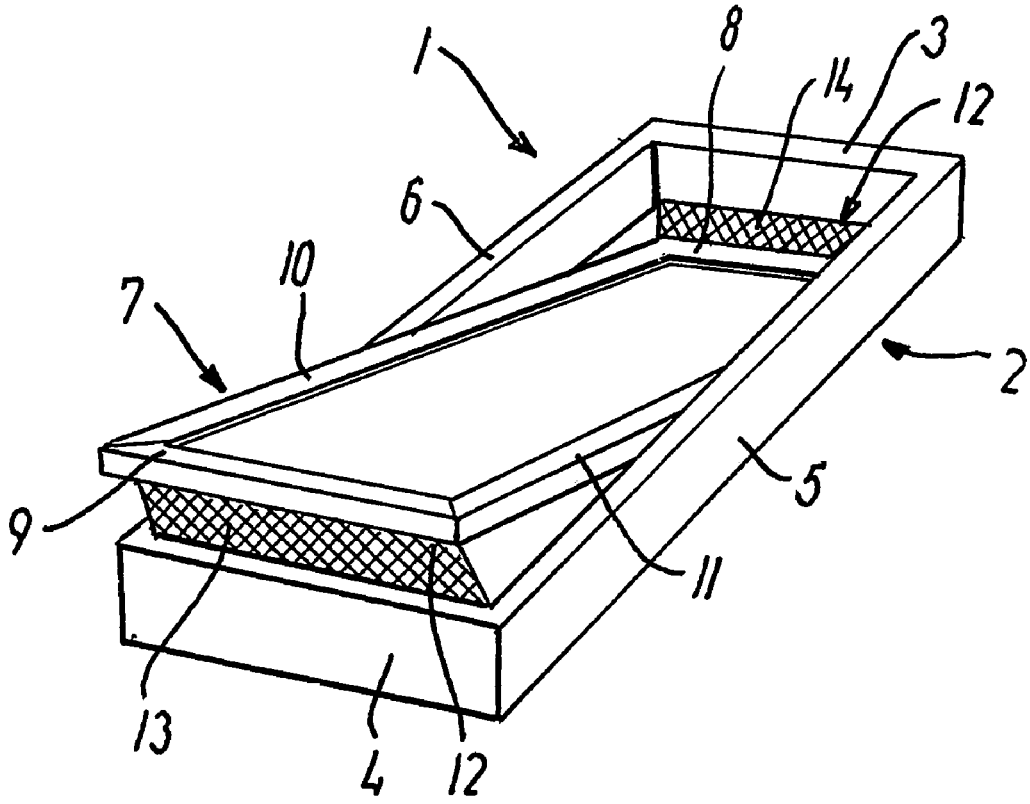

| | | | | | |
|---|---|---|---|---|---|
| 2,093,314 | A | * | 9/1937 | Macdonald | 160/183 |
| 2,207,856 | A | * | 7/1940 | Gieser | 160/28 |
| 2,261,941 | A | * | 11/1941 | Persson | 160/84.04 |
| 2,270,202 | A | | 1/1942 | Persson | |
| 2,311,413 | A | | 2/1943 | Persson | |
| 2,494,844 | A | * | 1/1950 | Tondora | 160/97 |
| 2,925,769 | A | * | 2/1960 | Kubatzky | 454/225 |
| 4,969,291 | A | | 11/1990 | Camara | |
| 5,694,996 | A | | 12/1997 | Vigenberg et al. | 160/93 |
| 6,089,302 | A | | 7/2000 | Britt | |

FOREIGN PATENT DOCUMENTS

| | | |
|---|---|---|
| DE | 2622170 | 11/1977 |
| DE | 7906434 | 6/1979 |
| EP | 0 638 704 | 2/1995 |
| JP | 61-76034 | 5/1986 |
| JP | 1-168685 | 11/1989 |
| JP | 11-166375 | 6/1999 |
| WO | WO 98/22684 | 5/1998 |
| WO | 01/55547 | 8/2001 |

OTHER PUBLICATIONS

English-language translation of JP11-166375 (3 pages).
Official Action dated Nov. 18, 2008 of Japanese Patent Application No. 2006-517966 (5 pages).
English-language translation (5 pages) of Official Action dated Nov. 18, 2008 of Japanese Patent Application No. 2006-517966.

* cited by examiner

WINDOW WITH SCREENING ARRANGEMENT

CROSS-REFERENCE TO RELATED APPLICATION

The present application claims the priority under 35 U.S.C. 119 of Danish Patent Application No. PA 2003 01047, filed Jul. 9, 2003, which is hereby incorporated herein by reference in its entirety.

The present invention relates to a window comprising: a frame having a top member, a bottom member and two side members defining a frame plane, a sash having a top member, a bottom member and two side members defining a sash plane, and a screening arrangement, said sash being connected to the frame by means of at least one hinge connection to provide a hinge axis substantially parallel with the frame top member and the sash top member, such that the sash may be moved from a closed position to a ventilating position, in which ventilating position the sash plane forms an angle within a limited angle range with the frame plane to provide at least one ventilating aperture, said screening arrangement covering said at least one ventilating aperture at least partly in the ventilating position, said screening arrangement comprising at least one screening element, which, in a closed position of the window, is arranged in an inactive position at the interface between frame and sash, and in the ventilating position spans the ventilating aperture between the frame bottom member and the sash bottom member, and/or between the frame top member and the sash top member, and that the at least one screening element is connected with the sash or frame top or bottom member and is in releasable engagement with the corresponding frame or sash member within said limited angle range.

Different kinds of windows with screening arrangements are known in the art. From AU-B-527915 and DE-A-2622170 it is known to provide a top-hung window, i.e. a window having its hinge axis at the top member of the frame, with an insect screening, which in the ventilating position of the window covers the wedge-shaped ventilating aperture. As the entire sash turns outwards when opening the window, the ventilating aperture may be covered by a single insect screen.

Windows of the pivoting or centre-hung type have found widespread acceptance, especially as roof windows, inter alia because this kind of window facilitates easy window cleaning, as the sash comprising the pane can be turned essentially 180° to allow cleaning of the outside surface of the pane from inside the building. A further advantage of this type of window it that it can be fully opened to a position where the sash is turned approximately 90° in which position air inlet is essentially unrestricted.

As the sash turns around a central pivot axis, one half of the sash turns outwards and one half of the sash turns inwards when the window is opened. This characteristic, however, entails some difficulties in the event that the window is to be equipped with a screening arrangement to e.g. restrict access of insects to the interior of the building through the openings between sash and frame when the window is opened.

Over the years different attempts have been made to provide a centre-hung window with a screening arrangement. One such screen is disclosed in U.S. Pat. No. 2,311,413. This prior art screen is arranged as a screen roller provided in the frame members and connected to the sash members and covers all openings of the window when it is tilted, and hence provides efficient screening of the window in the open position. It is, however, a disadvantage that the screen restricts the movement of the sash, and further, the screen must be disconnected to be able to clean the outside of the window pane, which is hence a somewhat laborious task. Moreover the screen must be removed before the window can be used as an exit, e.g. in case of a fire.

DE-U1-7906434 discloses a centre-hung window with a screen. This prior art screen is of fixed construction conforming to a maximum ventilation opening between frame and sash, i.e. the screen has the shape of a wedge with a cylindrical or approximately cylindrical main surface and a segment, which may be substantially in the form of a sector of a circle or triangular at each side. The screen may be partly foldable in that it may be hinged to the frame or sash, however, the screen will still be voluminous. As one of the screens at either the top or bottom of the window must be mounted on the inside of the window, this screen will be visible at all times from the inside, which makes this type of screen less advantageous. Further, in the event that the screen is folded away, the screen must be brought into position by reassembling the parts and engaging the parts with the sash and/or frame of the window before the screen is brought to its active position again.

Another screen for a centre-hung window is known from Applicant's U.S. Pat. No. 5,694,996, which discloses a screening arrangement mounted on the outside of the entire window encapsulating this. The screening arrangement comprises a screen-carrying frame having a first screen covering the window, and sides of a screen material of e.g. bellows shape. The window sash engages the screen-carrying frame forcing the screen-carrying frame outwards in response to the opening of the window. This screening arrangement ensures maximum protection against insects entering through the open window, however, the screening arrangement is of an elaborate design and also restricts light through the window, which in some cases is a drawback.

U.S. Pat. No. 2,270,202 discloses a screen for centre-hung windows. The screen comprises rollscreens arranged at the upper and lower edge of the window, and additional triangular side screens. The rollscreens are arranged at the window frame and releasably connected to the window sash. When the sash is to be moved further than its maximum ventilation position, the screen members must be detached from the window sash, which can be troublesome, and further the triangular side screens are visible at all times as they project from the plane of the window frame.

It is an object of the present invention to provide a window having a screening arrangement, which is discreet and has a minimum influence on the functioning of the window.

To achieve this object the screening arrangement in the window of the kind mentioned in the introduction comprises screening element or elements exclusively provided at the top and/or bottom member of the sash and the frame. Hereby a window and screening arrangement is obtained in which the screening elements are incorporated very discreetly and with a minimum influence on the functioning of the window, the screening element or elements being virtually invisible in the ventilating position as well as in the closed position of the window. Surprisingly, it turns out that acceptable ventilation is obtained with a minimum intervention into the sash and frame structure, and with a reduced expenditure with respect to material and manufacturing conditions as compared with prior art windows and screening arrangements.

Furthermore, the window may be of the top-hung, bottom-hung or centre-hung type, as the screening element or elements may be placed at one of or both the top and bottom frame and sash members.

Simple types of screening arrangements can be of a type where each of the screening elements must be operated independently of the sash and manually, according to a preferred embodiment, however, each of the screening elements of the screening arrangement is moved automatically from an inactive position corresponding the closed position of the window to an active position corresponding to the ventilating position, and from the active position to the inactive position when the window is brought from its ventilating position to its closed position. Hereby the operation of the window and screening arrangement is particularly easy, and the window can thus be operated by anybody without any technical knowledge of the system. Further there is no risk that the operator forgets to employ the screening arrangement or the operator may be too slow, with the attendant risk of e.g. entry of insects.

In an embodiment, which provides a particularly discreet appearance, the screening elements of the screening arrangement may be moved automatically from an active position corresponding to the ventilating position to an inactive position when the window is brought past its ventilating position to a more tilted position of the sash.

According to an embodiment, the screening arrangement includes at least one screening element formed as a flap connected with the top or bottom member of the frame or the sash by means of a hinge. This embodiment has the advantage that such a flap is very easy to install, and it may even be retrofitted to a window without any substantial difficulty or amendment of the window construction.

According to an embodiment, said flap is adapted to hang freely under influence of gravity. In this simple example the flap thus allowed to pivot freely about the hinge According to a further development, however, said flap is preloaded towards the active position of the screening element by means of a tensioning element such as a coil spring, whereby is achieved with simple means that the flap will abut on the corresponding, opposite frame or sash member, and hence automatically deploy to be active in the ventilating position of the window.

According to an alternative or supplementary embodiment, the screening arrangement includes at least one screening element formed as a curtain connected with the top or bottom member of the frame or the sash. With this embodiment a screening element is achieved, which has a high flexibility and the provision of a frame for a flexible screening material is rendered superfluous.

The curtain may for example be of a bellows-type, however according to an embodiment said curtain is a roll-up curtain preloaded in the direction of the inactive position of the screening element. With this kind of curtain the inactive position can readily be reached, in particular in case of an automatically activated screening arrangement.

According to an alternative embodiment said curtain is a folded curtain, which provides a relatively large screening area, while at the same time providing a screening element requiring a relatively limited storage room.

According to an embodiment the screening arrangement includes at least one screening element formed as a slider connected with the top or bottom member of the frame or the sash.

The slider may comprise some sort of screening element, such as a mesh mounted on a frame, however according to a particularly elegant and simple embodiment the slider includes a grid of wires or a plurality of fins or a brush.

The top and bottom members of the sash may be of square or rectangular cross section, but according to an embodiment each of the top and bottom members of the frame and/or sash is provided with a chamfer, whereby is achieved that the opening area between sash and frame member in the ventilating position is relatively large.

To facilitate the operation of the window and screening arrangement means may be provided for indicating the ventilating position. As an example, the hinge of the window may convenient be provided with position indicating means, such as a pin mounted on the frame to slide on a resilient path mounted on the sash, said slide having a position of rest for the pin, or vice versa.

In order to maximize the security against entry of insects, sealing means may be provided at each of the side members of the frame and the sash. Preferably, such sealing means comprise a sliding sealing or a brush element.

According to an embodiment, the sealing means are arranged to seal any gap between overlapping side members of frame and sash in the area between the hinge axis and the screening arrangement, whereby a particularly discreet and efficient screening is provided.

To further enhance the efficiency of the screening arrangement, the screening arrangement may further comprise interface screening means arranged at the interface between the screening element and the sash side members.

Figure 2:
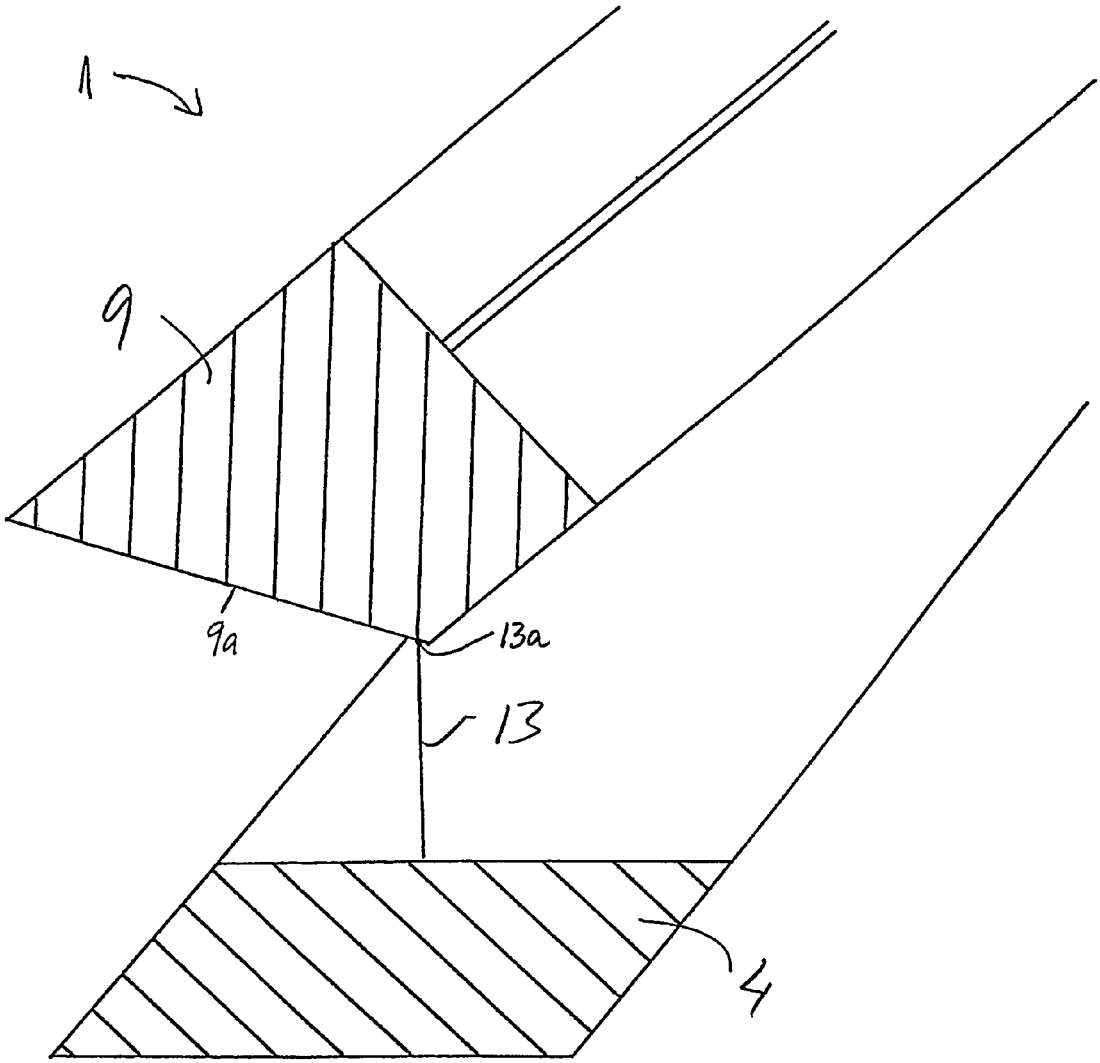
Figure 3:
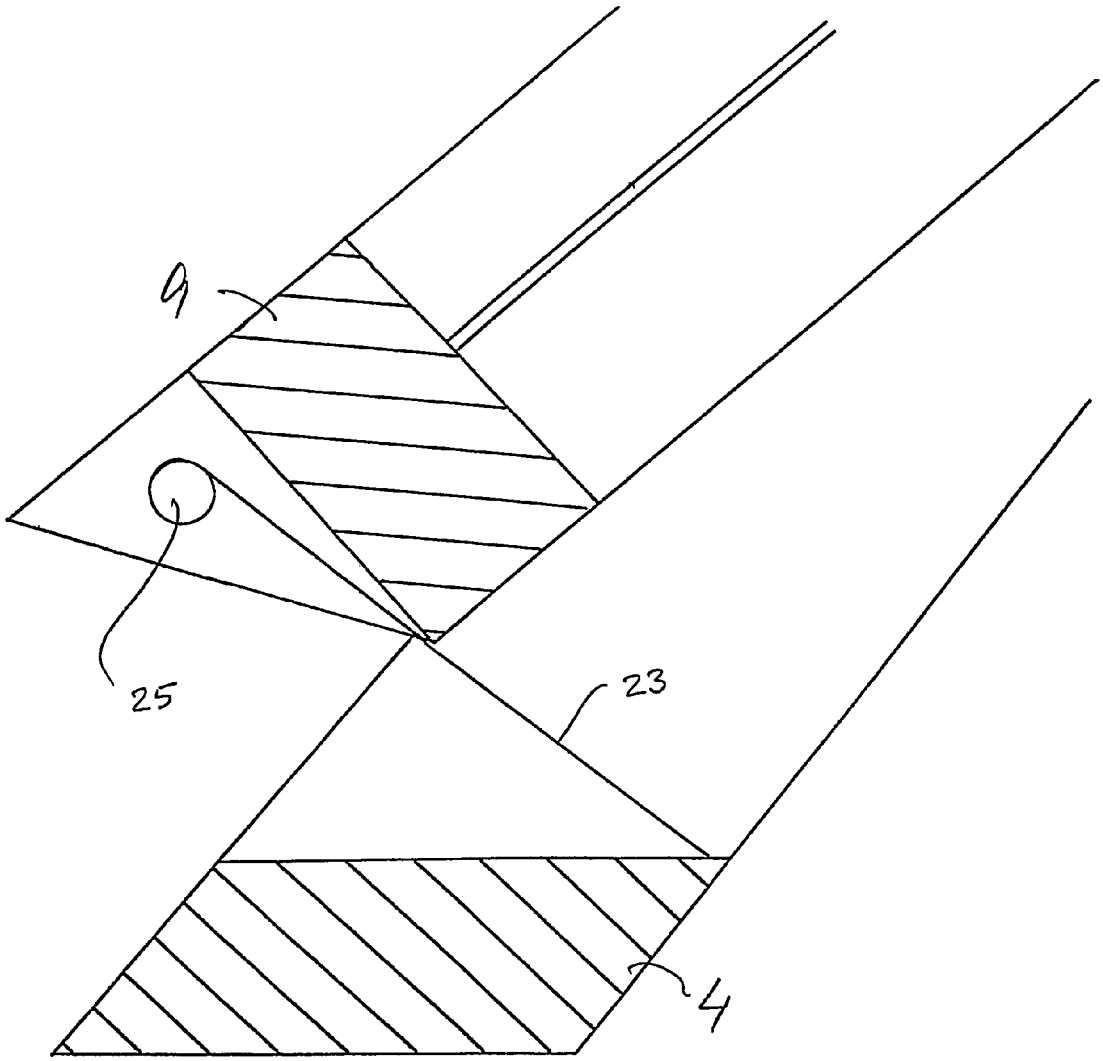
Figure 4:
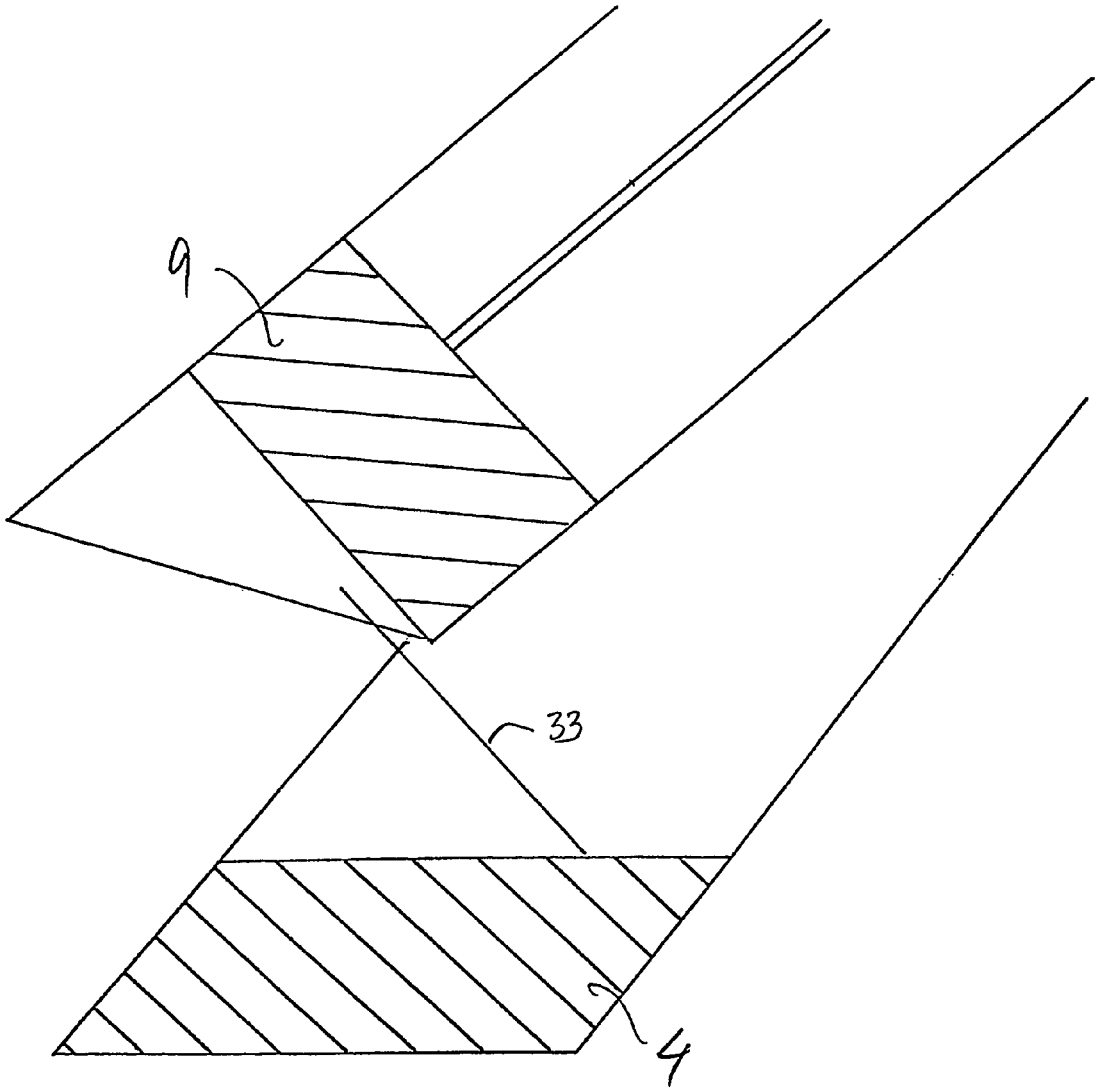
Figure 5:
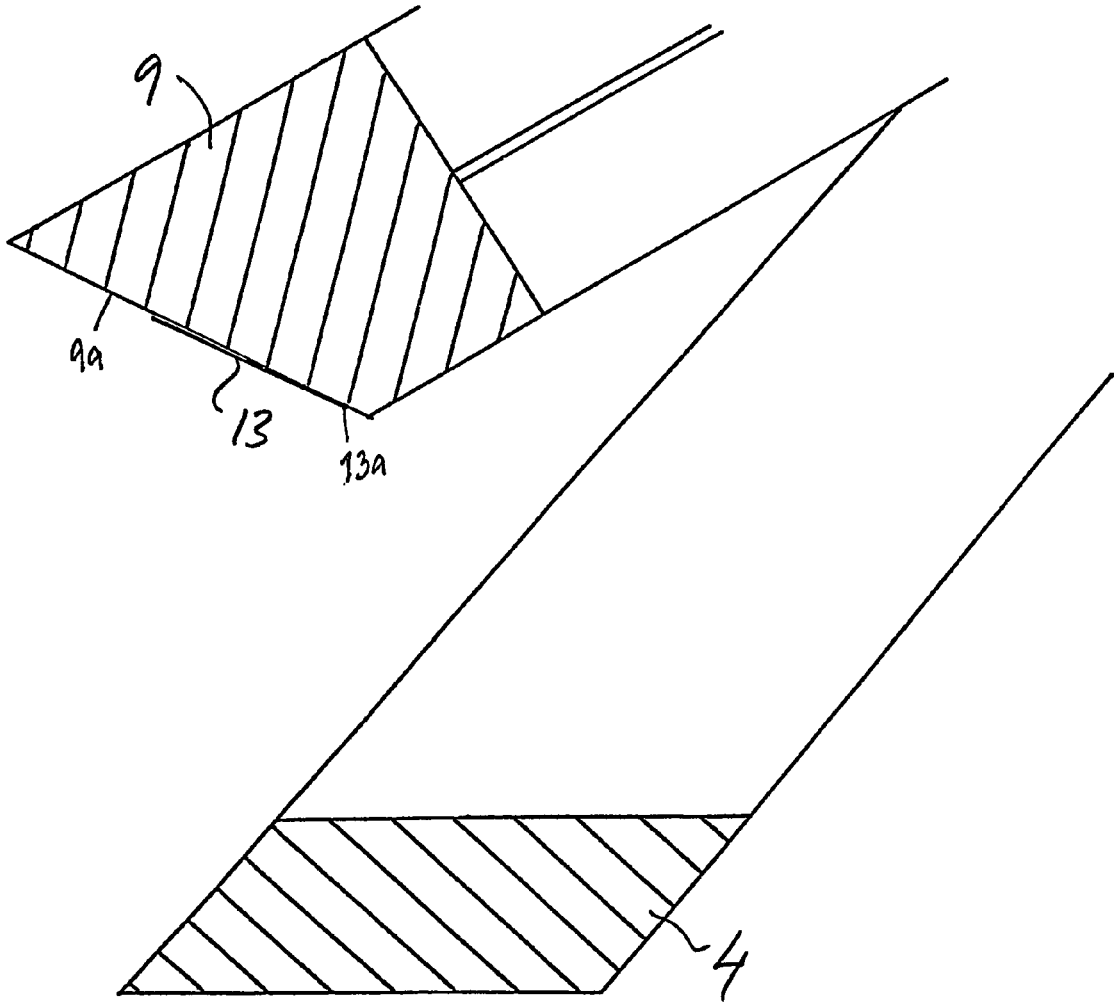
Figure 6:
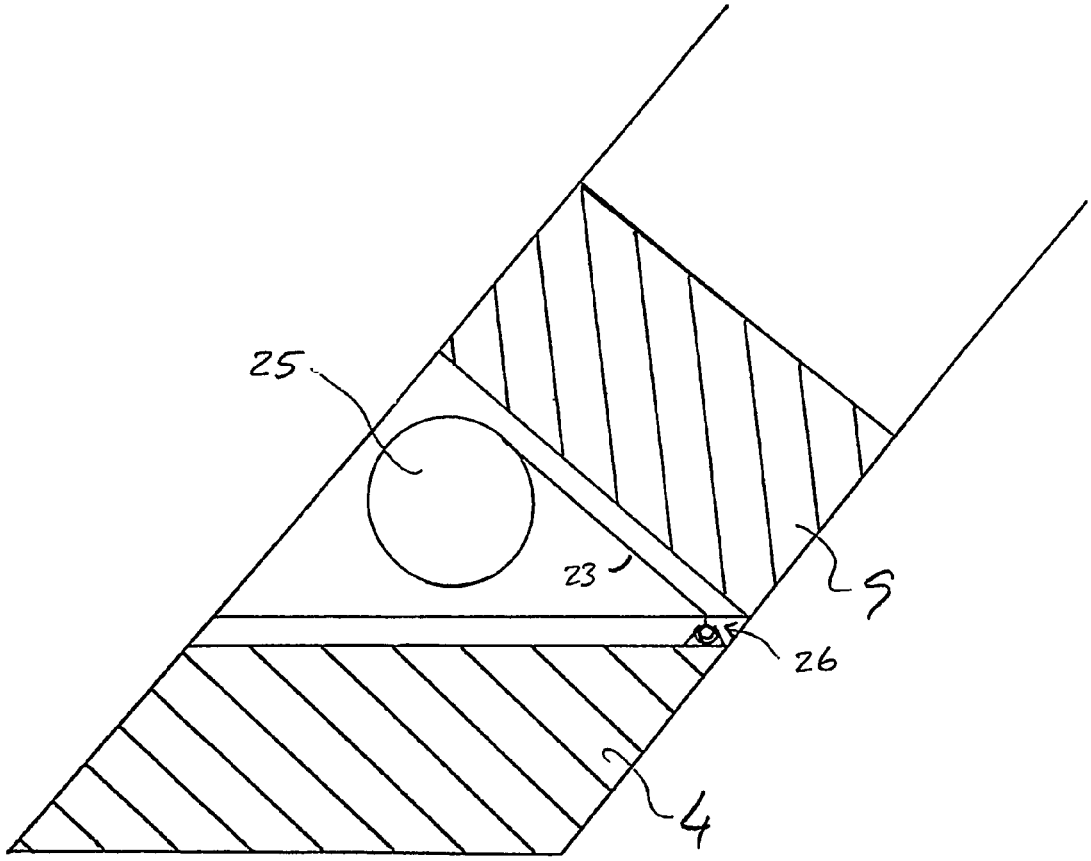

In the following the invention will be described in more detail by way of example and with reference to the drawing, in which FIG. 1 is a sketch of a window according to the invention, FIG. 2 is an enlarged view of a screening arrangement of the window of FIG. 1, FIG. 3 is a view corresponding to FIG. 2 of a screening arrangement according to a second embodiment, FIG. 4 is a view corresponding to FIG. 2 of a screening arrangement according to a third embodiment, FIG. 5 corresponds to the embodiment of FIG. 2, with the sash in a more tilted position, FIG. 6 is a cross section of a screening arrangement according to FIG. 3, in a closed position of the window.

Figure 7:
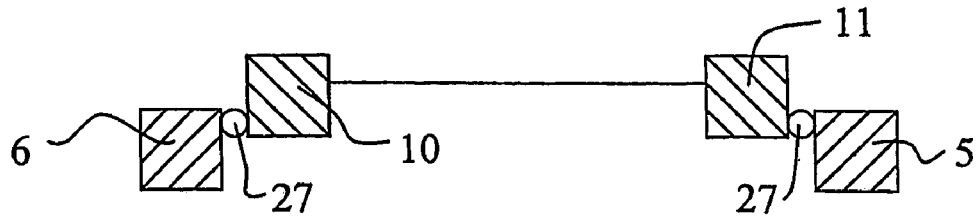
Figure 8A:
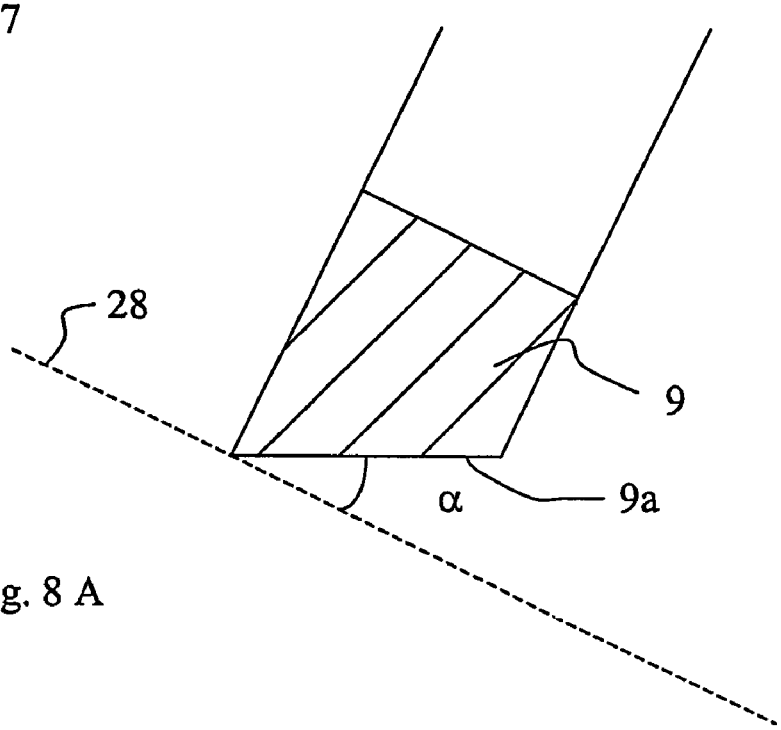
Figure 8B:
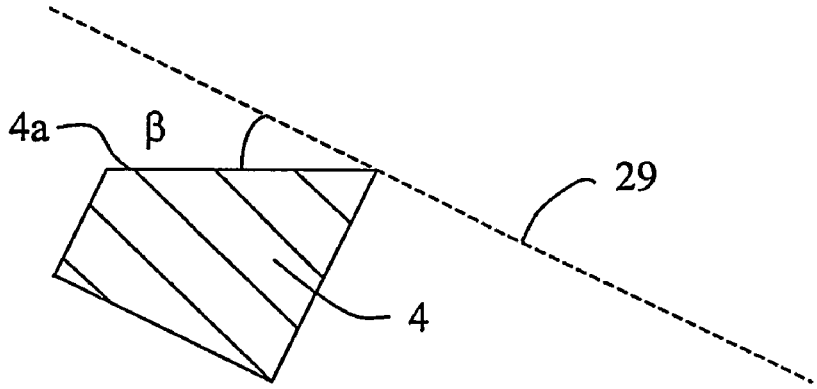
Figure 9A:
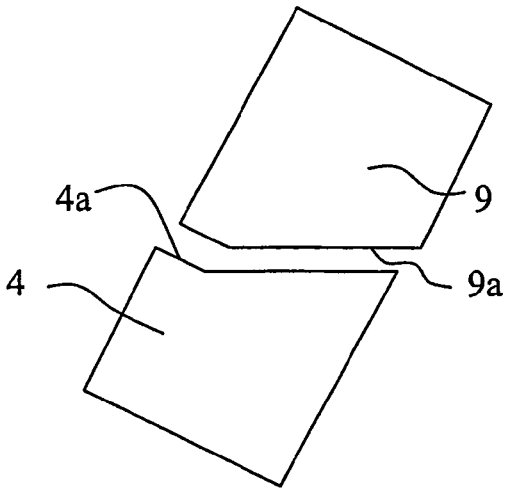
Figure 9B:
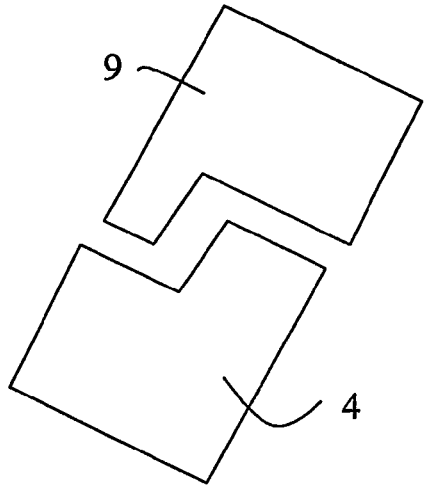
Figure 10:
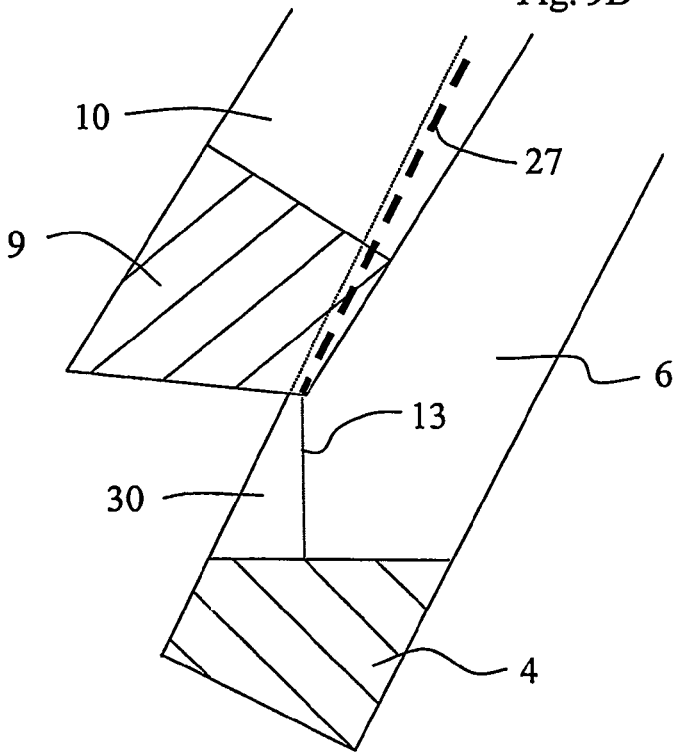
Figure 11:
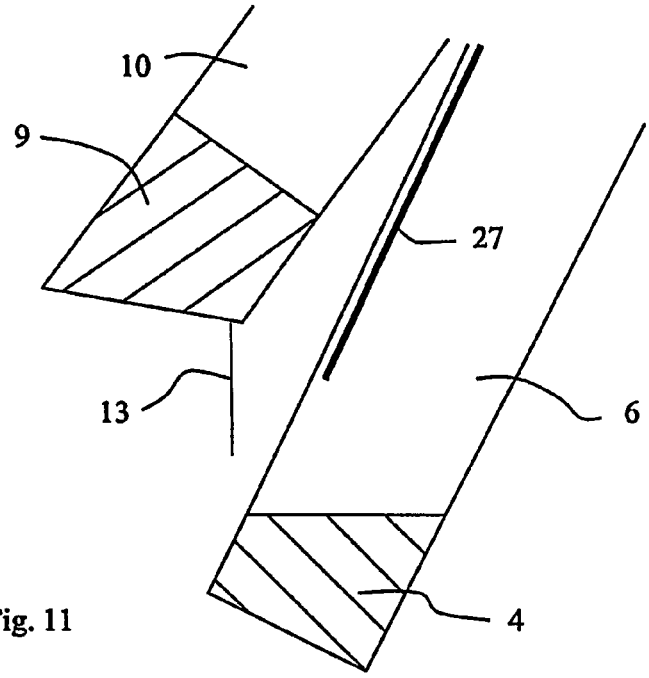
Figure 12:
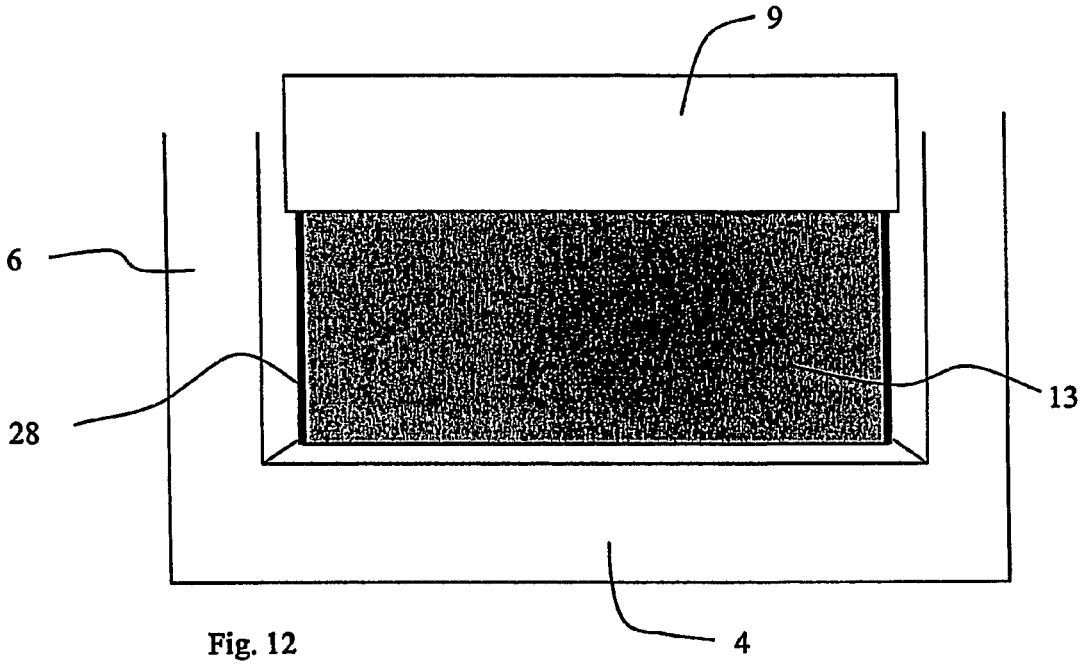

FIG. 7 is a cross section of the window side members in a ventilation position of the window, FIG. 8A is a section of the window sash bottom member, FIG. 8B is a section of the window frame bottom member, FIG. 9*a* is an alternative embodiment of the frame and sash bottom members in cross-section, FIG. 9*b* is another alternative embodiment of the frame and sash bottom members in cross-section, FIG. 10 is a cross-section of a lower part of the window in a ventilation position, FIG. 11 is an illustration as FIG. 10, but showing the window in a more open position, and FIG. 12 is a front elevational view of a lower part of the window.

For illustration of the invention the window 1 is shown somewhat simplified in FIG. 1. The window 1 comprises a frame 2 having a top member 3, a bottom member 4 and two side members 5, 6 defining a frame plane, and a sash 7 having a top member 8, a bottom member 9 and two side members 10, 11 defining a sash plane. As can be seen the window is, in the embodiment shown, centre-hung in that the sash 7 is connected to the frame 2 by a pivot hinge (not shown) provided between side members 5, 11; 6, 10 of the frame 2 and sash 7, respectively, to be openable by tilting the sash 7 of the window 1 about the hinge axis defined by the pivot hinge. The window 1 is further provided with a screening arrangement 12 comprising a screening element 14 extending between the top members 3, 8 of the frame 2 and sash 7, respectively, and a screening element 13 extending between the bottom members 4, 9 of the frame and sash, respectively. In order to show the principle underlying the invention, the window is shown in a position in which the screening elements at the top and bottom members of the sash and the frame are clearly visible.

It is noted that there is substantially no gap between the side members of the sash and frame, respectively. In the ventilating position, the sash and frame side members overlap each other such that they provide a sufficient security against entry of e.g. insects at the sides of the window. By a suitable design of the sash and frame it is possible to obtain a sealing cooperation between the respective side members. Such design may e.g. include side members having such dimensions that a snug fit is obtained, or the side members may be formed with grooves and/or shoulder portions to form a labyrinth-seal at the side members.

In order to ensure that the security against entry of insects is improved even further, the window may be provided with sealing means at the side members of the frame and the sash. Such sealing means may be of a kind known, per se, such as e.g. a sliding sealing or a brush element. In any event, the window will normally be provided with a weather strip between the side members of the frame and the sash. This weather strip will normally also hinder entry of insects.

The functioning of the screening arrangement is more readily understood based on FIG. 2, which is an enlarged view of the lower part of the window 1. The window is illustrated in a ventilating position, in which the sash 7 is tilted with respect to the frame 2 such that the sash plane forms a limited opening angle with the frame plane, such as 2-10°, preferably 5-7°, depending on the length of the window, to reveal a ventilation opening of 6-8 cm at the top and bottom of the window. In the ventilating position the screening element 13 covers the opening between the frame bottom member 4 and the sash bottom member 9. As can be seen, there are substantially no openings at the sides of the window in this slightly open position of the window, and hence there is, in many cases, virtually no need for a screen at the sides of the window. However, as described in the above, sealing means may be provided at the side members. In this embodiment, the screening element 13 is a flap, which may be connected to the sash by a hinge 13*a* (not shown in detail). The screening element 13 may be allowed to hang freely from the sash under influence of gravity only, and at present this simple embodiment is preferred, as it is the most robust and fail-safe embodiment. However, if considered necessary or advantageous, the screening element 13 may be preloaded in direction of the sash e.g. by a coil spring. The flap 13 may e.g. be connected with the sash bottom member 9 by means of one or more magnets, or other suitable non-permanent connection means. The flap 13 is thus moved from an inactive position, in which it rests on the inner surface 9*a* of the sash bottom member 9, to an active position, in which the end of the flap 13 opposite the hinge 13*a* is brought into abutment with the frame bottom member 4. It should be noted that the flap may as well be connected with the frame member, as long as the screening element is accommodated at the interface between the sash and the frame in its storage position. As an alternative, the screening element may be positioned outside the plane of the frame and/or sash, although this is not preferred as the screening element would then be visible when the window is closed. In this connection, it should furthermore be noted that the term "interface" should be interpreted in a broad sense, i.e. as encompassing the area at or near the surfaces facing each other. In the embodiment of FIG. 2, this area thus comprises e.g. the lower surfaces 9*a* and the adjacent border portions of the outer and inner surfaces. Further, screening element 13 may be a folded flap, to thereby provide a screen having a larger screening area and/or a screen requiring a reduced storage area.

As is also apparent from FIG. 2, the sash bottom member 9 is provided with a chamfer, such that the lower surface 9*a* forms an angle with respect to the outer and inner surfaces. Hereby, a larger ventilating aperture is obtained. In order to eliminate or at least reduce the need for sealing means at the side members, the side members should be substantially planar.

An alternative embodiment of the screening arrangement can be seen in FIG. 3, which is an enlarged view of the lower part of the window 1. Again the window is illustrated in a ventilating position, in which a screening element 23 covers the opening between the frame bottom member 4 and the sash bottom member 9. In this embodiment, the screening element 13 is a curtain in the form of a roller screen comprising a roller 25, which may be housed in the sash bottom member 9 as shown or in the frame bottom member 4. The screening element 23 is connected to the opposite bottom member, i.e. to the frame bottom member 4 in the embodiment shown. The roller 25 may be preloaded to a storage position in which virtually the whole screening element 23 is rolled up on the roller 25.

A third embodiment of the screening arrangement can be seen in FIG. 4, which is an enlarged view of the lower part of the window 1. Again the window is illustrated in a ventilating position, in which the screening element 33 covers the opening between the frame bottom member 4 and the sash bottom member 9. In this embodiment, the screening element 33 is a slider of fins, lamella or a mesh protruding from the sash bottom member 9 and hence screening the opening between the sash bottom member 9 and the frame bottom member 4. It is preferred that the slider is preloaded or biased in direction of the inactive, retracted position, where the slider is stored in the sash bottom member 9. Alternatively the slider may be preloaded or biased in direction of the active, protruding position, where the slider constitutes a screen covering the opening between the frame and sash. As will be clear to the skilled person, the slider can also be housed in the frame bottom member 4. The slider may be formed by an element having itself a sufficient length in order to bridge the gap between the corresponding sash and frame members in the ventilating position, or it may be formed as a set of mutually displaceable and connected elements such that a telescopic configuration is obtained.

Common to the embodiments shown in FIGS. 2-4 is that the screening element 13, 23, 33 only covers the opening between the sash and frame up to a limited opening angle of the sash, i.e. in a ventilating position of the window, whereas the screening element disengages from one of the frame or sash members when the opening angle of the sash exceeds this limited opening angle, thereby allowing practically unrestricted airflow through the openings between the sash and the frame. This is illustrated in FIG. 5, which correspond to the embodiment of FIG. 2, where the sash is tilted past the limited opening angle. In this position, the flap constituting the screening element 13 in this embodiment is disengaged from the bottom frame member 4, and preferably pivoted to a storage position in abutment with the inner surface 9*a* underneath the sash bottom member 9, as shown. As previously mentioned the flap may be preloaded towards said storage position, such that the flap will automatically pivot to this storage position when the sash is tilted past the limited opening angle. Alternatively the flap may be pivoted and fixed in the storage position manually, or the flap may be allowed to hang from the sash bottom member 9.

FIG. 6 corresponds to the embodiment of FIG. 3, however in a closed position of the window. The roller 25 is housed in the sash bottom member 9, and in this position of the sash most of the screening element 23 is rolled onto the roller 25. As schematically shown, the end of the screening element 23 is connected to the frame bottom member 4 by an engagement means 26, such as any kind of releasable snap lock, Velcro or a magnet. The engagement means 26 is adapted to hold the end of the screening element 23 until the sash is tilted so much that all the screen material has been unwound from the roller 14, corresponding to the limited opening angle. Further, the engagement means is adapted to allow disengagement of the screen from the frame bottom member 4, while on the other hand providing a perceptible resistance to disengagement when the sash is tilted past the limited opening angle of the ventilation position. By providing a perceptible resistance to disengagement, the user is informed that the screen is disengaged. It is preferred that the engagement means will automatically reconnect when the window is fully closed again, so the screen is ready for operation when the window is opened. The schematically illustrated engagement means 26 is solely an example and other embodiments are possible, such as a hook and latch mechanism or the like.

As previously mentioned the window may be fitted with a sealing between side members of the frame and sash. This is schematically illustrated in FIG. 7, which is a cross section of the window side members in a ventilation position of the window. Between the frame side members 5, 6 and the sash side members 10, 11, is arranged a sealing 27 extending substantially along the full length of the window. The sealing 27 may be mounted on the sash side member or the frame side member to provide the most effective and discreet sealing.

Although the principle according to the invention can be used to screen any kind of window, it is preferred that the geometry of the opposing top and/or bottom members of the sash and frame is adapted for the purpose of providing a relatively large screenable opening. FIG. 8A is a section of the sash bottom member 9 according to an embodiment. The sash bottom member 9 comprises a lower surface 9*a*, which is arranged at an angle a with respect to the sash normal plane 28 extending normal to the plane of the paper in the illustration. As mentioned earlier, arranging the lower surface 9*a* with a chamfer or at an angle, will provide a relatively large screenable opening between the sash and frame bottom parts when the sash is tilted only limited, whereas the side members still overlap. As the side members overlap, there is no need for separate screening elements at the side members. FIG. 8B is a section of the corresponding frame bottom member 4 having an angled upper surface 4*a*. As illustrated the frame bottom member upper surface 4*a* is arranged at an angle β with respect to the frame normal plane 29 extending normal to the paper plane in the illustration. The angle β would normally be equivalent to the angle α. The angle depends on the construction of the window and the hinge mechanism, as well as the inclination of the roof in which the window is installed. As always, the choice of angle is a compromise between conflicting interests. A large angle will allow for a large opening, but also increase the consumption of material during manufacture of the members, the size of the installed window construction etc. Suitable values for the angle lie within the range of 20-70°, preferably approximately 45°.

Alternative geometries of the opposing faces of the top members and/or bottom members 4, 9 are also possible. FIG. 9*a* illustrates an embodiment, in which only a part of the opposing surfaces 4*a*, 9*a* of the frame bottom member 4 and the sash bottom member 9, respectively, is angled. FIG. 9*b* illustrates another alternative embodiment, in which the opposing surfaces 4*a*, 9*a* of the frame bottom member 4 and the sash bottom member 9, respectively, are stepped.

FIG. 10 is an illustration corresponding to FIG. 2. For illustration the previously mentioned, optional sealing 27 arranged between the frame side member 6 and the sash side member 10 is shown with broken line, although in this view it is hidden behind the sash. The only opening around the window hence is the bottom opening 30 (and the top opening in case of a centre-hung window). This bottom opening is provided with a screening element 13 to avoid ingress of insects, when the window is tilted a limited angle as illustrated and as previously explained.

FIG. 11 is an illustration of a particularly simple embodiment of the invention, with the window in a position more open than the ventilating position of FIG. 10. The screening element 13 is arranged to extend freely downward from the sash bottom member 9, to which the screening element 13 is connected by a hinge (not shown). The screening element 13 extends downward under influence of gravity. This embodiment is particularly simple, and thus inexpensive, robust and fail-safe. The screening element 13 may be adapted to pivot to an inactive position when the window is closed. To this the frame bottom member 4 may be provided with a guiding means (not shown) for the screening element 13. It is also contemplated to provide other window parts with guiding means for the screening element, if this should be considered advantageous.

As schematically illustrated in FIG. 12, the interface between the screening element 13 and the sash side members 5, 6 may be provided with an interface screening element 28 to avoid any entry of insects at the interface. The interface screening element 28 may for example be provided as a brush element arranged at the sides of the screening element, or alternatively at the frame side members 5, 6.

Again it will be evident to the skilled person that a similar screening arrangement and engagement means may be provided at the upper part of the window, and that the screening arrangement may be provided at the frame instead of at the sash.

The description above is only an example, and it will be evident to the skilled person that the inventive principle can also find application on e.g. top-hung windows.

The invention claimed is:

1. A window comprising:

a frame having a top member, a bottom member and two side members defining a frame plane, a sash having a top member, a bottom member and two side members defining a sash plane, an interface between the frame and the sash, including an interface between each of the frame side members and corresponding sash side members, a screening arrangement, said sash being connected to the frame by means of at least one hinge connection to provide a hinge axis substantially parallel with the frame top member and the sash top member, such that the sash may be moved from a closed position to a ventilating position, in which ventilating position the sash plane forms an angle within a limited angle range with the frame plane to provide at least one ventilating aperture, said screening arrangement covering said at least one ventilating aperture at least partly in the ventilating position, said screening arrangement comprising at least one screening element, which, in a closed position of the window, is arranged in an inactive position at the interface between frame and sash, and in the ventilating position spans the ventilating aperture between the frame bottom member and the sash bottom member, and/or between the frame top member and the sash top member, and that the at least one screening element is connected with the sash or frame top or bottom member and is in releasable engagement with the corresponding frame or sash member within said limited angle range, wherein said at least one screening element is provided exclusively at the top and/or bottom member of the sash and the frame, the interface between each of the frame side members and the corresponding sash side members being devoid of screening elements that extend as the window moves from the closed position to the ventilating position, wherein said at least one screening element releases from engagement with the corresponding frame or sash member in response to said sash being moved beyond the ventilating position in a direction away from the closed position, wherein each of the frame side members has an inner surface and an outer surface spaced from one another in a direction perpendicular to the frame plane, wherein each of the sash side members has an inner surface and an outer surface spaced from one another in a direction perpendicular to the sash plane, and wherein the interface between each of the frame side members and the corresponding sash side members comprises an arrangement selected from the group consisting of a) sealing means mounted on one of i) the sash side member, wherein the sealing means is positioned entirely between the inner and outer surfaces of the frame side member when the sash has not been moved beyond the ventilating position in a direction away from the closed position and ii) the frame side member, wherein the sealing means is positioned entirely between the inner and outer surfaces of the sash side member when the sash has not been moved beyond the ventilating position in a direction away from the closed position, b) an interface screening element mounted between the at least one screening element and the adjacent frame side member, wherein the interface screening element is mounted on one of i) the sides of the at least one screening element, between the inner and outer surfaces of the adjacent frame side member, and ii) the adjacent frame side member, between the inner and outer surfaces of the frame side member, and c) a sealing cooperation of the sash side members themselves with the corresponding frame side members themselves, wherein the sash side members are in sealing cooperation with the corresponding frame side members when the sash is in the ventilating position.

2. A window as claimed in claim 1, wherein the at least one screening element of the screening arrangement is adapted to be moved automatically from an inactive position corresponding the closed position of the window to an active position corresponding to the ventilating position, and from the active position to the inactive position when the window is brought from its ventilating position to its closed position.

3. A window as claimed in claim 1, wherein the at least one screening element of the screening arrangement is adapted to be moved automatically from an active position corresponding to the ventilating position to an inactive position when the window is brought past its ventilating position to a more tilted position of the sash.

4. A window as claimed in claim 1, wherein the screening arrangement includes at least one screening element formed as a flap connected with the top or bottom member of the frame or the sash by means of a hinge.

5. A window according to claim 4, wherein said flap is adapted to hang freely under influence of gravity.

6. A window as claimed in claim 4, wherein said flap is preloaded towards the active position of the screening element by means of a tensioning element.

7. A window as claimed in claim 6, wherein said tensioning element is a coil spring.

8. A window as claimed in claim 1, wherein the screening arrangement includes at least one screening element formed as a curtain connected with the top or bottom member of the frame or the sash.

9. A window as claimed in claim 8, wherein said curtain is a roll-up curtain preloaded in the direction of the inactive position of the screening element.

10. A window as claimed in claim 8, wherein said curtain is a folded curtain.

11. A window as claimed in claim 1, wherein the screening arrangement includes at least one screening element formed as a slider connected with the top or bottom member of the frame or the sash.

12. A window as claimed in claim 11, wherein the slider includes a grid of wires or a plurality of fins or a brush.

13. A window as claimed in claim 1, wherein each of the top and bottom members of the frame and/or sash is provided with a chamfer.

14. A window as claimed in claim 1, wherein said arrangement consists of said sealing means.

15. A window as claimed in claim 14, wherein said sealing means comprises a sliding sealing or a brush element.

16. A window according to claim 15, wherein the sealing means is arranged to seal any gap between overlapping side members of frame and sash in the area between the hinge axis and the screening arrangement.

17. A window according to claim 14, wherein the sealing means is arranged to seal any gap between overlapping side members of frame and sash in the area between the hinge axis and the screening arrangement.

18. A window according to claim 1, wherein said arrangement consists of said interface screening element.

19. A window comprising:

a frame having a top member, a bottom member and two side members defining a frame plane, a sash having a top member, a bottom member and two side members defining a sash plane, an interface between the frame and the sash, including an interface between each of the frame side members and corresponding sash side members, a screening arrangement, said sash being connected to the frame by means of at least one hinge connection to provide a hinge axis substantially parallel with the frame top member and the sash top member, such that the sash may be moved from a closed position to a ventilating position, in which ventilating position the sash plane forms an angle within a limited angle range with the frame plane to provide at least one ventilating aperture, said screening arrangement covering said at least one ventilating aperture at least partly in the ventilating position, said screening arrangement comprising at least one screening element, which, in a closed position of the window, is arranged in an inactive position at the interface between frame and sash, and in the ventilating position spans the ventilating aperture between the frame bottom member and the sash bottom member, and/or between the frame top member and the sash top member, and that the at least one screening element is connected with the sash or frame top or bottom member and is in releasable engagement with the corresponding frame or sash member within said limited angle range, wherein said at least one screening element is provided exclusively at the top and/or bottom member of the sash and the frame, the interface between each of the frame side members and the corresponding sash side members being devoid of screening elements that extend as the window moves from the closed position to the ventilating position, wherein said at least one screening element is adapted to release from engagement with the corresponding frame or sash member in response to said sash being moved beyond the ventilating position in a direction away from the closed position, wherein each of the frame side members has an inner surface and an outer surface spaced from one another in a direction perpendicular to the frame plane, wherein each of the sash side members has an inner surface and an outer surface spaced from one another in a direction perpendicular to the sash plane, and wherein the interface between each of the frame side members and the corresponding sash side members comprises an arrangement selected from the group consisting of a) sealing means mounted on one of i) the sash side member, wherein the sealing means is positioned entirely between the inner and outer surfaces of the frame side member when the sash has not been moved beyond the ventilating position in a direction away from the closed position and ii) the frame side member, wherein the sealing means is positioned entirely between the inner and outer surfaces of the sash side member when the sash has not been moved beyond the ventilating position in a direction away from the closed position, b) an interface screening element mounted between the at least one screening element and the adjacent frame side member, wherein the interface screening element is mounted on one of i) the sides of the at least one screening element, between the inner and outer surfaces of the adjacent frame side member, and ii) the adjacent frame side member, between the inner and outer surfaces of the frame side member, and c) a sealing cooperation of the sash side members themselves with the corresponding frame side members themselves, wherein the sash side members are in sealing cooperation with the corresponding frame side members when the sash is in the ventilating position.

* * * * *